US006489577B2

(12) United States Patent
Kurata

(10) Patent No.: US 6,489,577 B2
(45) Date of Patent: Dec. 3, 2002

(54) ELECTRICALLY OPERATING APPARATUS FOR CIRCUIT BREAKER

(75) Inventor: Kohei Kurata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/981,732

(22) Filed: Oct. 19, 2001

(65) Prior Publication Data

US 2002/0070103 A1 Jun. 13, 2002

(30) Foreign Application Priority Data

Dec. 8, 2000 (JP) ..... 2000-374322

(51) Int. Cl.[7] ..... H01H 9/00

(52) U.S. Cl. ..... 200/331; 200/400; 200/330; 200/318; 200/321; 200/322

(58) Field of Search ..... 200/17 R, 400, 200/401, 500, 501, 318, 321, 322, 329, 330, 331, 332, 334

(56) References Cited

U.S. PATENT DOCUMENTS 4,975,673 A 12/1990 Ikehata et al. ..... 337/79
5,504,290 A 4/1996 Baginski et al. ..... 200/401
5,575,381 A * 11/1996 Castonguay et al. ..... 200/400
5,762,181 A * 6/1998 Castonguay et al. ..... 200/400
6,087,610 A * 7/2000 Castonguay et al. ..... 200/400
6,166,343 A * 12/2000 Blessitt et al. ..... 200/400

* cited by examiner

*Primary Examiner*—Michael Friedhofer
(74) *Attorney, Agent, or Firm*—Sughrue Mion, PLLC

(57) ABSTRACT

An apparatus for electrically operating a circuit breaker arranged such that the change-over lever movable between an electrical operation mode position and a manual operation mode position has provided therewith a blocking portion which, while allowing the operation of the manual operation handle when the change-over lever is in the manual operation mode position, engages the manual operation handle to prevent the operation of the manual operation handle when the change-over lever is at the electrical operation mode position. Therefore, the operation of the manual operation handle in the electrical operation mode can be ensured to be prevented, avoiding the damages to the electrical operating apparatus, thsu enabling to provide a highly reliable apparatus for electrically operating a circuit breaker.

5 Claims, 9 Drawing Sheets

ELECTRICALLY OPERATING APPARATUS FOR CIRCUIT BREAKER

CROSS REFERENCE TO RELATED APPLICATION

This application is based on Application No. 2000-374322, filed in Japan on Dec. 8, 2000, the contents of which are hereby incorporated by reference.

BACKGROUND OF THE INVENTION

This invention relates to an apparatus for electrically operating a circuit breaker and, more particularly, to an apparatus for switching an operating handle of a circuit breaker by electrical or manual operation.

A circuit breaker, which is a device for interrupting a fault current such as a short-circuiting current flowing through an electrical circuit as an overcurrent, is equipped with an electrically operating apparatus which achieves the circuit interruption.

An example of the apparatus for electrically operating a circuit breaker of such type can be found in Japanese Patent Laid-Open No. 6-251687 (or U.S. Pat. No. 5,504,290) and is shown in FIGS. 8 and 9. In FIGS. 8 and 9, the reference numeral 1 is an electrically operating apparatus including a drive motor 2, 3 is a change-over lever for shifting between a manual operation mode and an electrical operation mode, the switching of the change-over switch 4 can be achieved by sliding the change-over lever 3 into the direction of an arrow B1 or an arrow B2 (to the left or right in FIG. 8). That is, when the change-over lever 3 is slid in the direction of the arrow B2 to change the mode into the electrical operation mode, an electric current is supplied to the drive motor 2 and when the change-over lever 3 is slid in the direction of the arrow B1 to change the mode into the manual operation mode, no current is supplied to the drive motor 2.

The reference numeral 5 is a manual operation handle for manually opening the circuit breaker, 6 is an ON button for closing the circuit breaker, 7 is a TRIP button for opening the circuit breaker, 8 is a main shaft for transmitting the operational force from the drive motor 2 and the manual operation handle 5, 9 are cams mounted on the main shaft 8, 10 are drive levers for transmitting a drive force on the main shaft 8 through the cams 9, 11 are rollers rotatably mounted to the drive levers 10 and brought into contact with the cams 9, 13 is an actuating pin secured to the drive levers 9 and 12 is an operation handle engaging the actuating pin 13.

In the conventional apparatus as above described, when the change-over lever 3 is slid in the direction of the arrow B1, the change-over switch 4 is opened and the manual operation mode is established.

When the manual operation handle 5 is moved up and down as shown in an arrow C in FIG. 8, the main shaft 8 rotates. Then, the drive levers 10 are rotated through the cams 9 and the actuating pin 13 causes the operation handle 12 to operate to open the circuit breaker. When the ON button 6 is depressed, the circuit breaker is closed by the action of the energy charging spring (not shown) which is charged by the rollers 11 during the rotation of the drive levers 10. When the TRIP button 7 is depressed, the trip device (not shown) initiates the trip operation (same as the operation due to an overcurrent) and the circuit breaker is opened.

On the other hand, when the change-over lever 3 is slid into the arrow B2, the change-over switch 4 is closed to establish the electrical operation mode. In this mode, the circuit breaker can be opened or closed by energizing the drive motor 2 by remote control to rotate the main shaft 8. When the change-over lever 3 is slid in the direction of the arrow B2, the change-over lever 3 engages with an engagement portion 6*a* disposed on the ON button 6 and an engagement portion 7*a* disposed on the TRIP button 7. Therefore, the ON button 6 and the TRIP button 7 are prevented from moving further by the change-over lever 3. On the other hand, the manual operation handle 5 does not have any structure that is restricted by the change-over lever 3, so that the manual operation handle 5 is in the state in which it can be freely operated.

In such the conventional apparatus for electrically operating a circuit breaker, the manual operation handle 5 is not prevented from moving by the change-over lever 5 even when the circuit breaker is being remote controlled by the drive force of the drive motor 2 in the electrical operation mode, so that the manual operation handle 5 can be moved, whereby the drive motor 2 constituting the electrical operating apparatus 1 is locked and may be damaged.

SUMMARY OF THE INVENTION

Accordingly, the chief object of the present invention is to provide an apparatus for electrically operating a circuit breaker free from the above discussed problems of the conventional apparatus.

Another object of the present invention is to provide an apparatus for electrically operating a circuit breaker in which not only the ON button and the TRIP button but also the manual operation handle can be prevented from being moved during the electrical operation mode, whereby the electrical operation apparatus is not damaged and a reliable operation can be ensured.

With the above objects in view, the present invention resides in an apparatus for electrically operating a circuit breaker, in which a control panel on a housing of the circuit breaker is provided therein a change-over lever for selectively changing between an electrical operation mode and a manual operation mode, and in which the circuit breaker is operated between the open and closed positions by a drive force from a drive motor during the electrical operation mode and the circuit breaker is operated between the open and closed positions by a drive force from a manual operation handle during the manual operation mode. The apparatus is arranged such that the change-over lever moves between an electrical operation mode position corresponding to the electrical operation mode and a manual operation mode position corresponding to the manual operation mode, and that the change-over lever has provided therewith a blocking portion which, while allowing the operation of the manual operation handle when the change-over lever is in the manual operation mode position, engages the manual operation handle to prevent the operation of the manual operation handle when the change-over lever is at the electrical operation mode position.

The control panel may comprise an ON button for closing the circuit breaker in the manual operation mode and a TRIP button for opening the circuit breaker in the manual operation mode, and the change-over lever may be provided with a first engagement portion and a second engagement portion engaging the ON button and the TRIP button to prevent the operations of the ON button and the TRIP button when the change-over lever is shifted into the electrical operation mode.

The change-over lever may have the blocking portion, the first engagement portion and the second engagement portion provided thereon as an integral and unitary structure.

Alternatively, apparatus for electrically operating a circuit breaker may further comprise a switch disposed in the vicinity of the change-over lever for controlling electric current supply to the drive motor in response to the position of the change-over lever, the switch supplying the current to the drive motor when the change-over lever is in the electrical operation mode position and supplying no current to the drive motor when the change-over lever is in the manual operation mode.

The manual operation handle may comprise a first link mounted to an energy charging means actuating shaft for actuating energy charging means, a second link pivotally connected to the first link and a spring for biasing the second link toward the position in which the second link is housed within the housing of the electrically operating apparatus, and the arrangement may be such that, when the manual operation handle is operated, the first link is rotated over a first rotation range in which the first link is rotated against the action of the spring until it engages with the second link as well as a second rotation range in which the first link, together with the second link, drives the energy charging means actuating shaft.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 6:
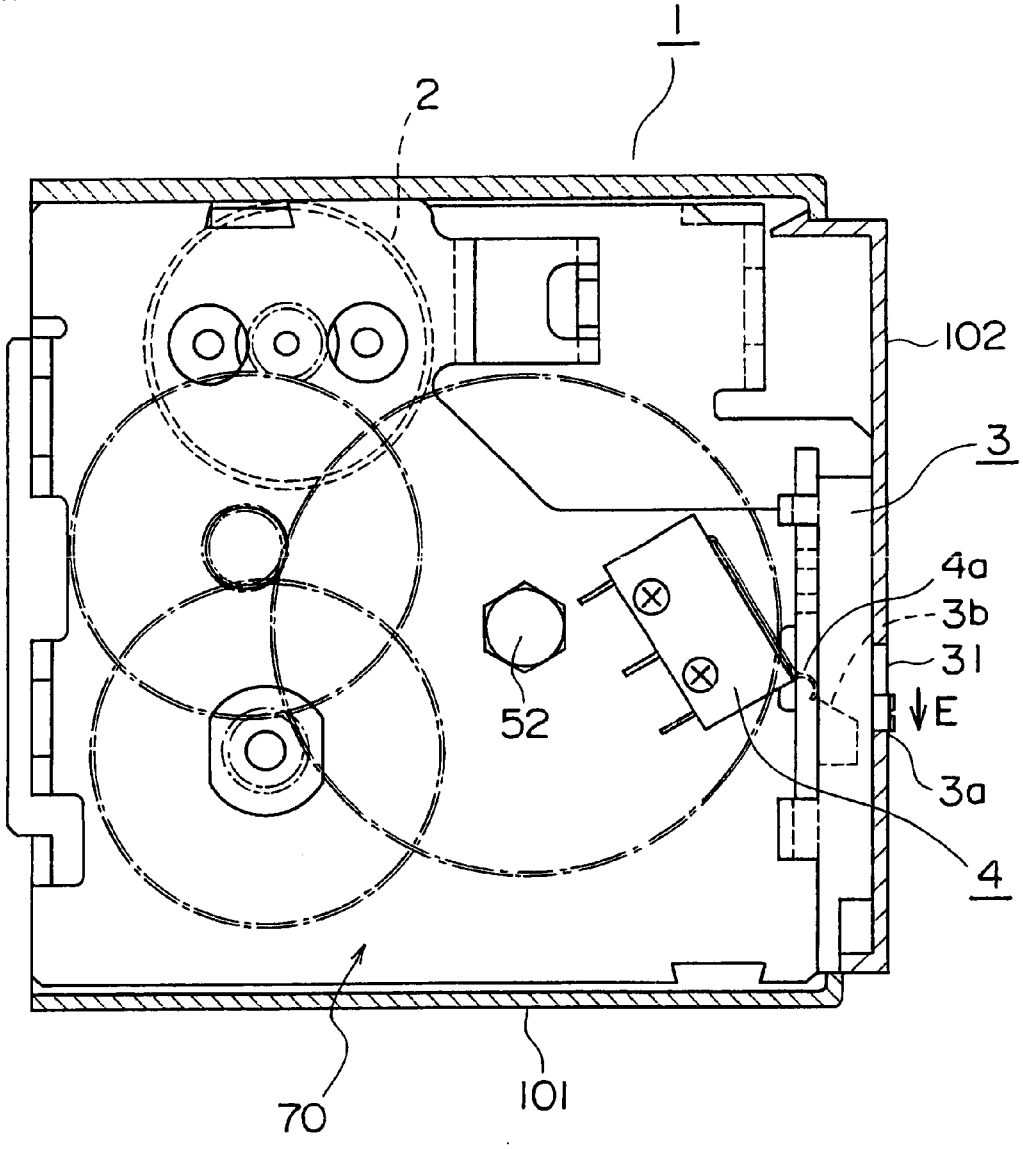
FIG. 6 is a left hand side view of the electrically operating apparatus shown in FIG. 5 with the housing removed.
Figure 7:
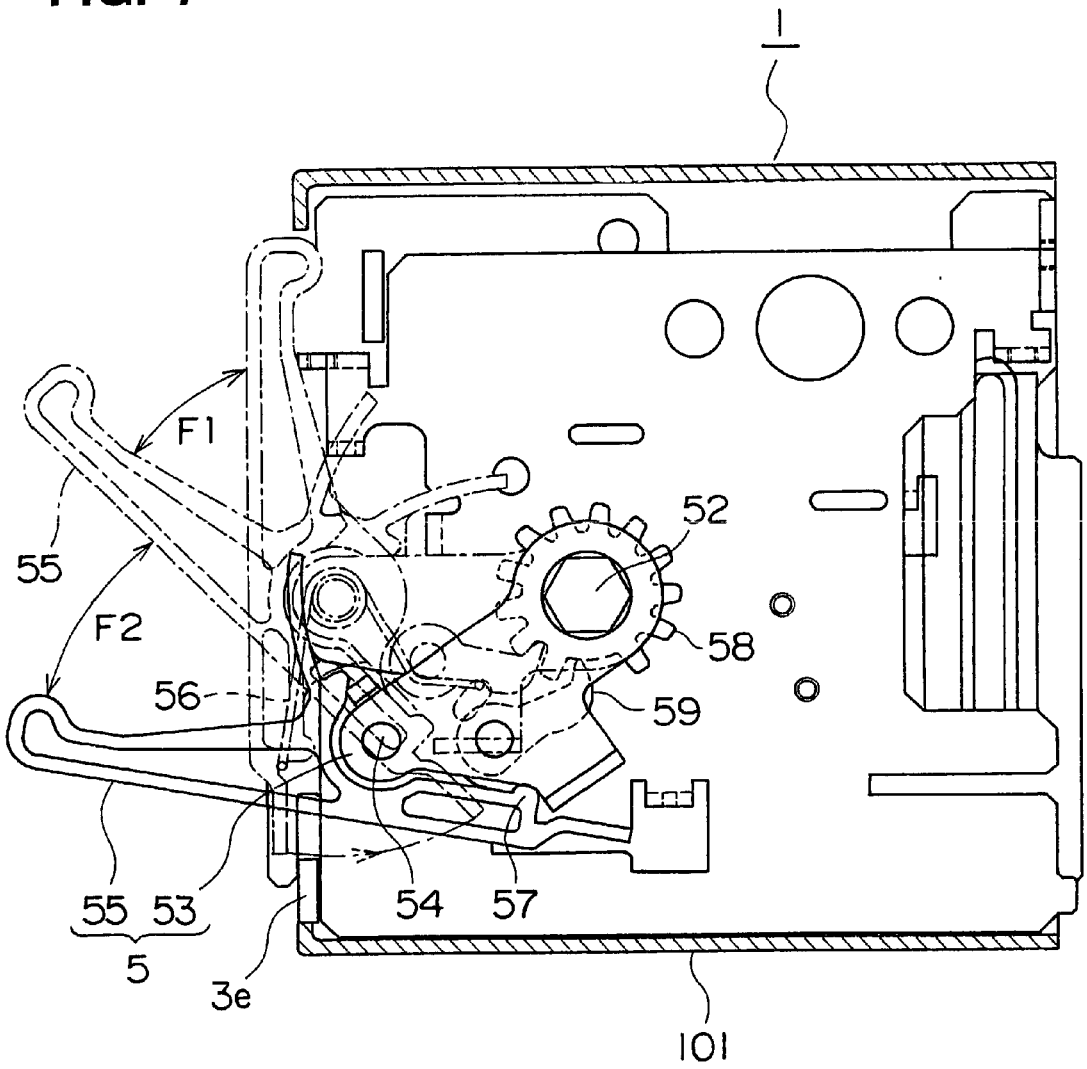
FIG. 7 is a right hand side view of the electrically operating apparatus shown in FIG. 5 with the housing removed.
Figure 8:
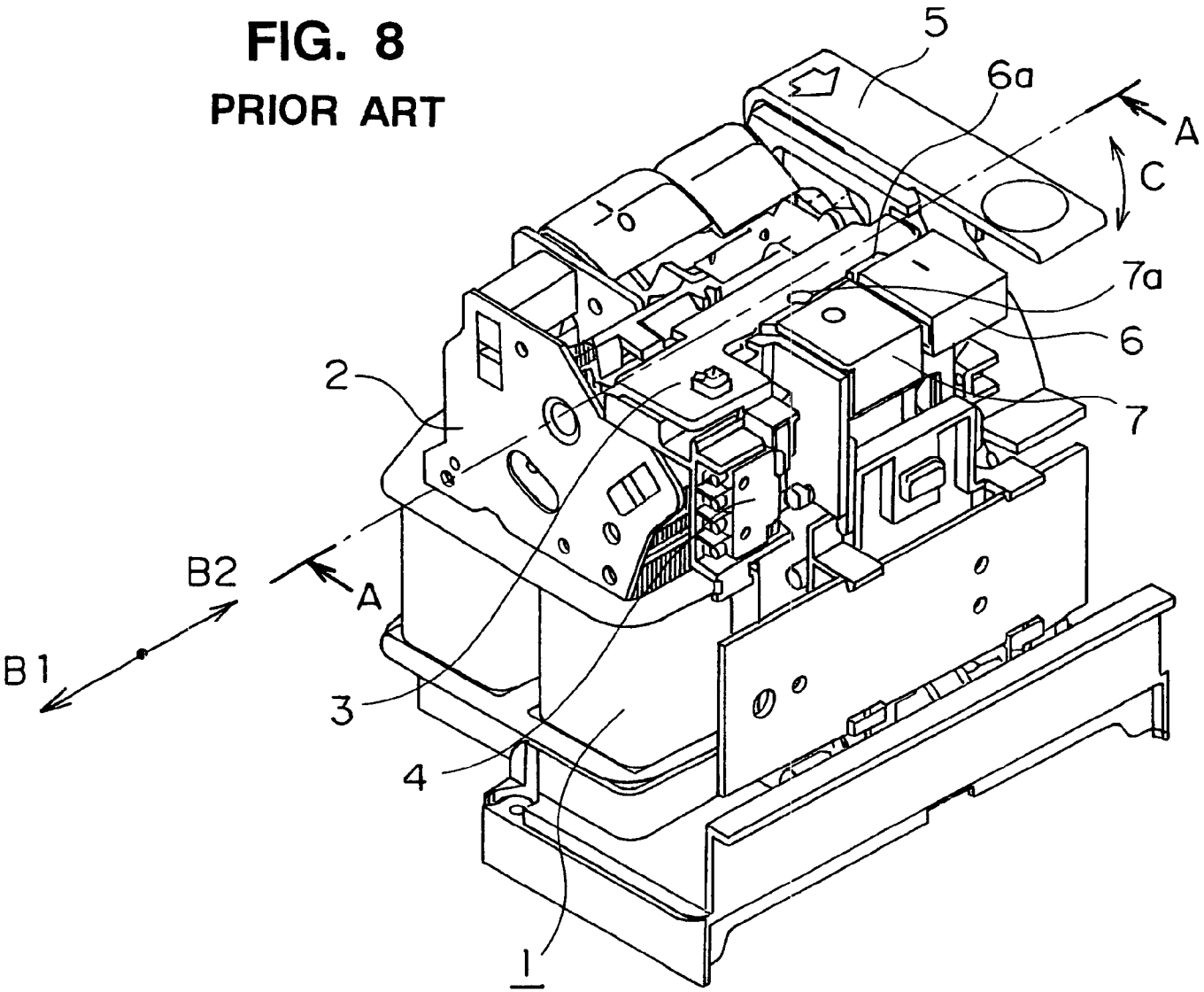
FIG. 8 PRIOR ART
FIG. 8 is a perspective view showing an outer appearance of the conventional electrically operating apparatus for a circuit breaker.
Figure 9:
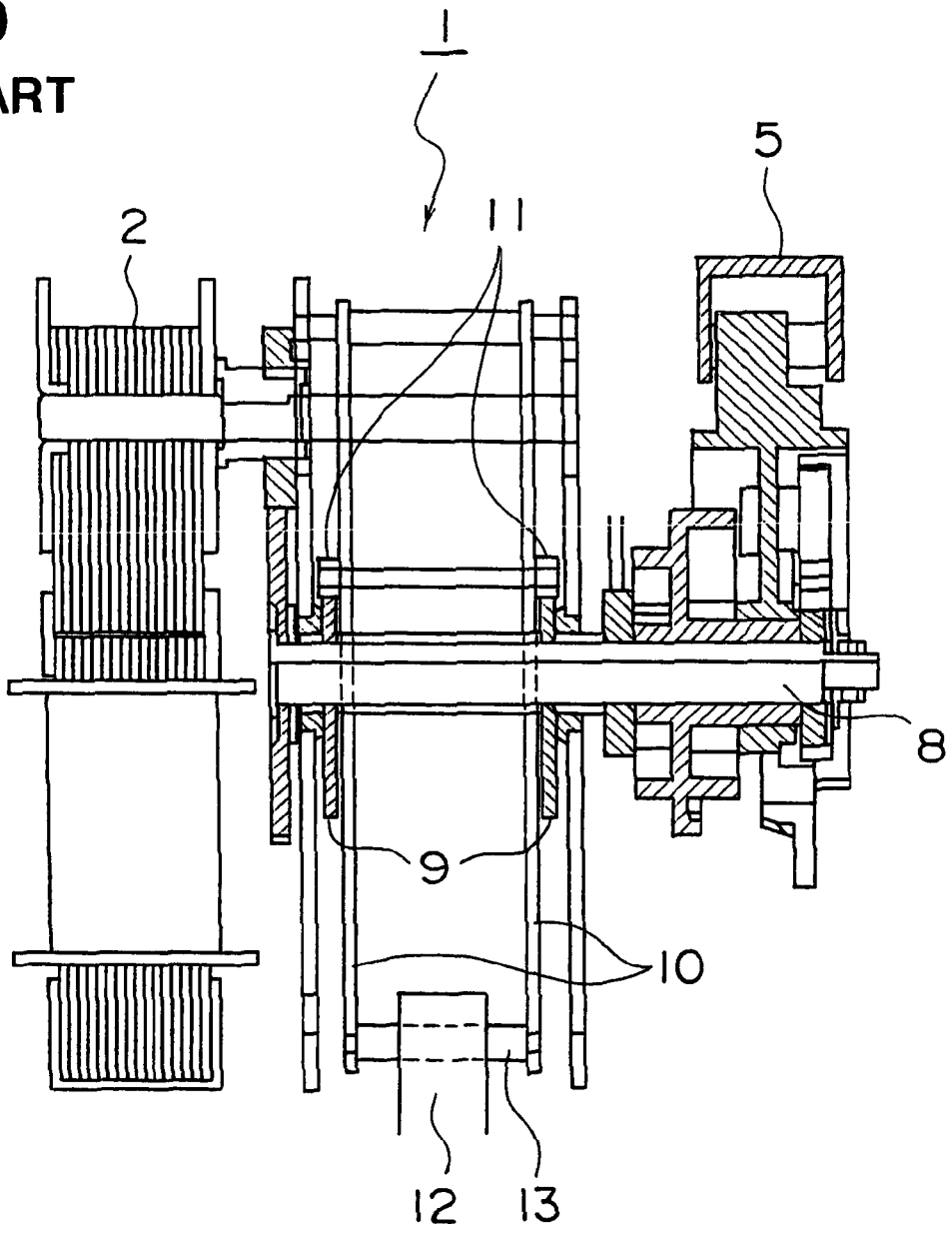
FIG. 9 PRIOR ART
FIG. 9 is a sectional view taken along line A - A of FIG. 8.

FIGS. 1 to 7 illustrate one embodiment of the apparatus for operating a circuit breaker of the present invention and the same reference numerals indicate identical or corresponding components to those of the conventional apparatus explained in conjunction with FIGS. 8 and 9.

In the figures, the reference numeral 1 indicates an electrical operating apparatus, 100 is a circuit breaker disposed at the back of the electrical operating apparatus 100 and 101 is a housing of the electrical operating apparatus. Disposed within the interior of the housing 101 are a drive motor 2 for electrically operating the circuit breaker 100, a change-over lever 3, a switch 4 disposed in the vicinity of the change-over lever 3 for controlling the electric current supply to the drive motor 2, an ON button 6 for closing the circuit breaker 100, a TRIP button 7 for tripping the circuit breaker 100, a transmission gear unit 70 for transmitting a drive force generated by the drive motor 2, a mechanism unit 80 and a manual operation handle device 30 having a manual operation handle 5 for manually operating the circuit breaker 100.

Disposed on the front of the housing 101 is an operation panel 102 (not shown in FIG. 7) having formed therein guide windows 31, 51 and 71 for guiding and supporting various operating members. Within these guide windows, the operating members are disposed, operating members including the change-over lever 3 for shifting the switch 4 which supplies an electric current to the drive motor 2 during the operation in the electrical operation mode and which does not supply the electric current to the drive motor 2 during the operation in the manual operation mode is disposed and, similarly, the manual operation handle 5 for operating the manual operation handle device 30, the ON button 6, the TRIP button and the like. That is, the operating knob 3*a* provided on the change-over lever 3 is movable up and down with respect to the window 31 and when it is moved upward the change-over lever 3 is brought into the electrical operation mode position and when it is moved down ward the change-over lever 3 is slid into the manual operation mode position. The manual operation handle 5 is accommodated within the guide window 51 so that its outer surface is substantially flash with the surface of the operating panel 102 and, when the manual operation handle 5 it to be operated, it is rotated outwardly from its retracted position and guided by the window 51. The ON button 6 and the TRIP button 7 are guided by the windows 61 and 71, respectively, to be depressed back ward. The reference numeral 12 designates an operational handle for opening and closing the contacts (not shown) of the circuit breaker 100, and 13 and 14 are actuating pins constituting a mechanism portion 80 for making a reciprocating up and down motion (FIG. 2) of the operational handle 12.

The change-over lever 3 is a substantially L-shaped member made of a thermoplastic resin material, which has integrally formed as a unitary structure, in addition to the above-mentioned operating knob 3*a* for the sliding movement of the change-over lever 3, a step portion 3*b* in the form of a recess, a first engagement portion 3*c* for engaging with the ON button 6 to prevent the operation of the ON button 6, a second engagement portion 3*d* for engaging the TRIP button 7 to prevent the operation of the TRIP button 7, and a block portion 3*e* for engaging the manual operation handle 5 to prevent the movement of the manual operation handle 5.

The step portion 3*b* is formed in the back of the change-over lever 3 and is engageable with the lever 4*a* of the switch 4 so that the change-over switch 4 may be closed or opened. In the electrical operation mode position shown in FIG. 3 in which the operating knob 3*a* of the change-over lever 3 is moved in the direction of the arrow D within the guide window 31, the lever 4*a* falls within the step portion 3*b* and closes the change-over switch 4 so that an electric current can be supplied to the drive motor 2. Also, in FIG. 6 in which the operating knob 3*a* is moved in the direction of the arrow E and the change-over lever 3 is positioned in the manual operation mode position, the lever 4*a* of the switch 4 is outside of the step portion 3*b* and the switch 4 is opened, thus the electric current is not supplied to the drive motor 2.

When the change-over lever 3 is shifted into the electrical operation mode, the change-over lever 3 enters behind, as viewed from the control panel 102, the ON button 6, the TRIP button 7 and the tip portion 5*a* of the manual operation handle 5, so that the first engagement portion 3*c*, the second engagement portion 3*d* and the block portion 3*e* establish overlapping portions (illustrated by the hatched portion in FIG. 2) that overlap with the change-over lever 3, whereby the depression of the buttons 6 and 7 and the driving (FIG. 4) of the manual operation handle 5 is restricted to prevent the respective operations. On the other hand, when the change-over lever 3 is shifted into the manual operation mode, the first engagement portion 3*c*, the second engagement portion 3*d* and the block portion 3*e* retreat from the ON button 6, the TRIP button 7 and the tip portion 5*a* of the manual operation handle 5 to be disengaged therefrom, allowing each of the buttons 6 and 7 and the manual operation handle 5.

Figure 1:
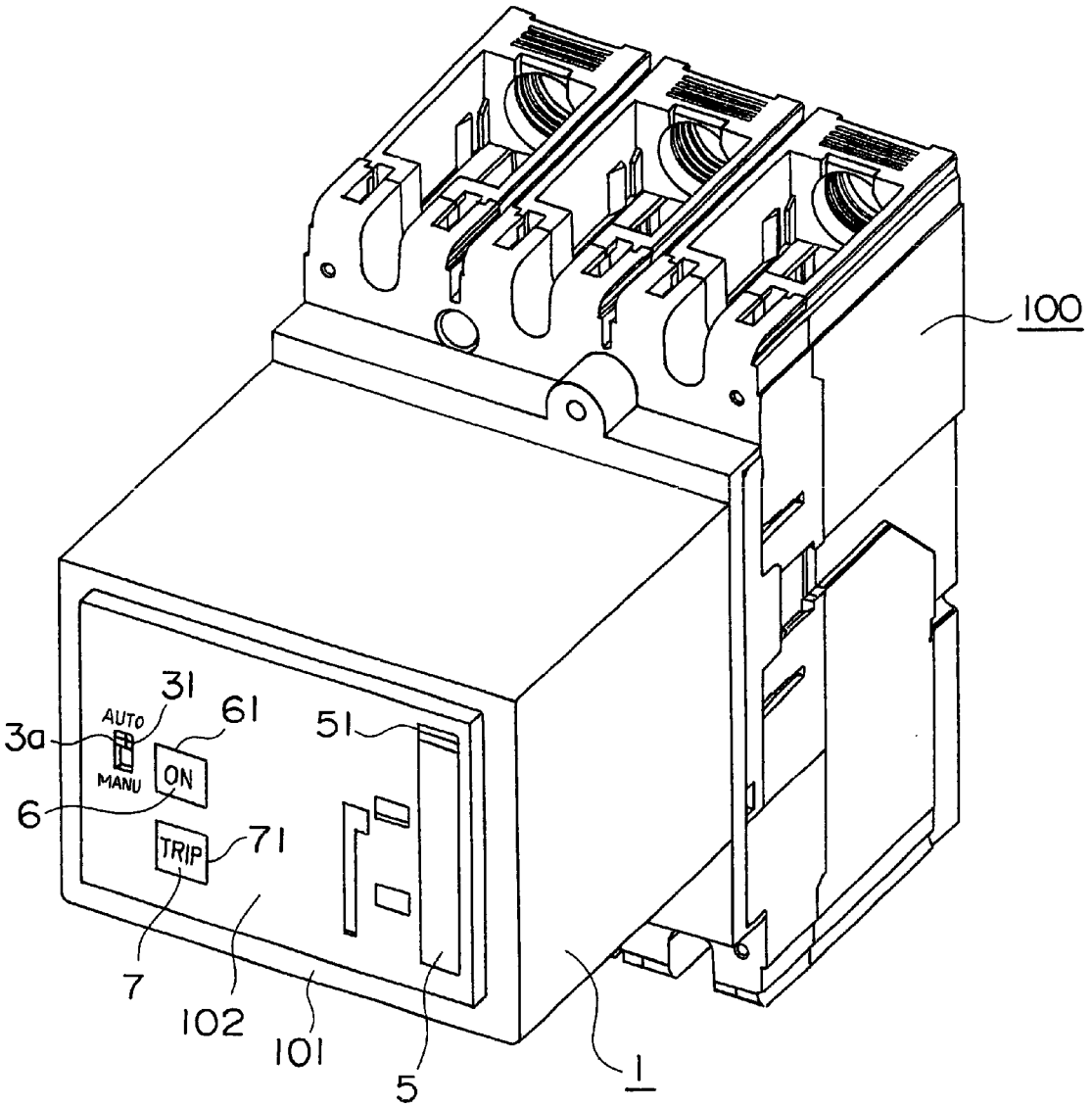
FIG. 1 is a perspective view showing an outer appearance of the electrically operating apparatus of an embodiment of the present invention.
Figure 2:
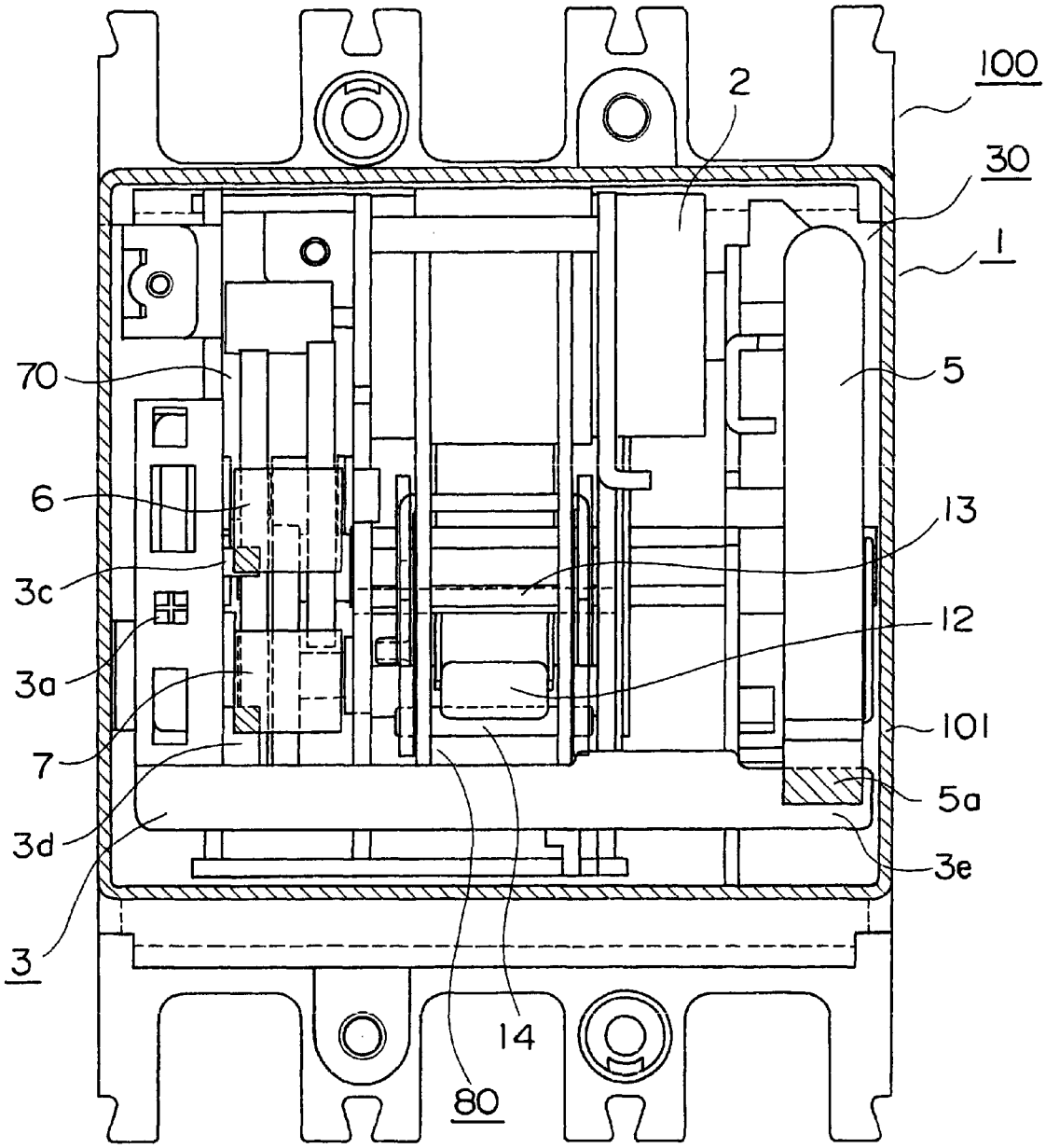
FIG. 2 is a front view of the electrically operating apparatus in the electrical operation mode with the housing removed.
Figure 3:
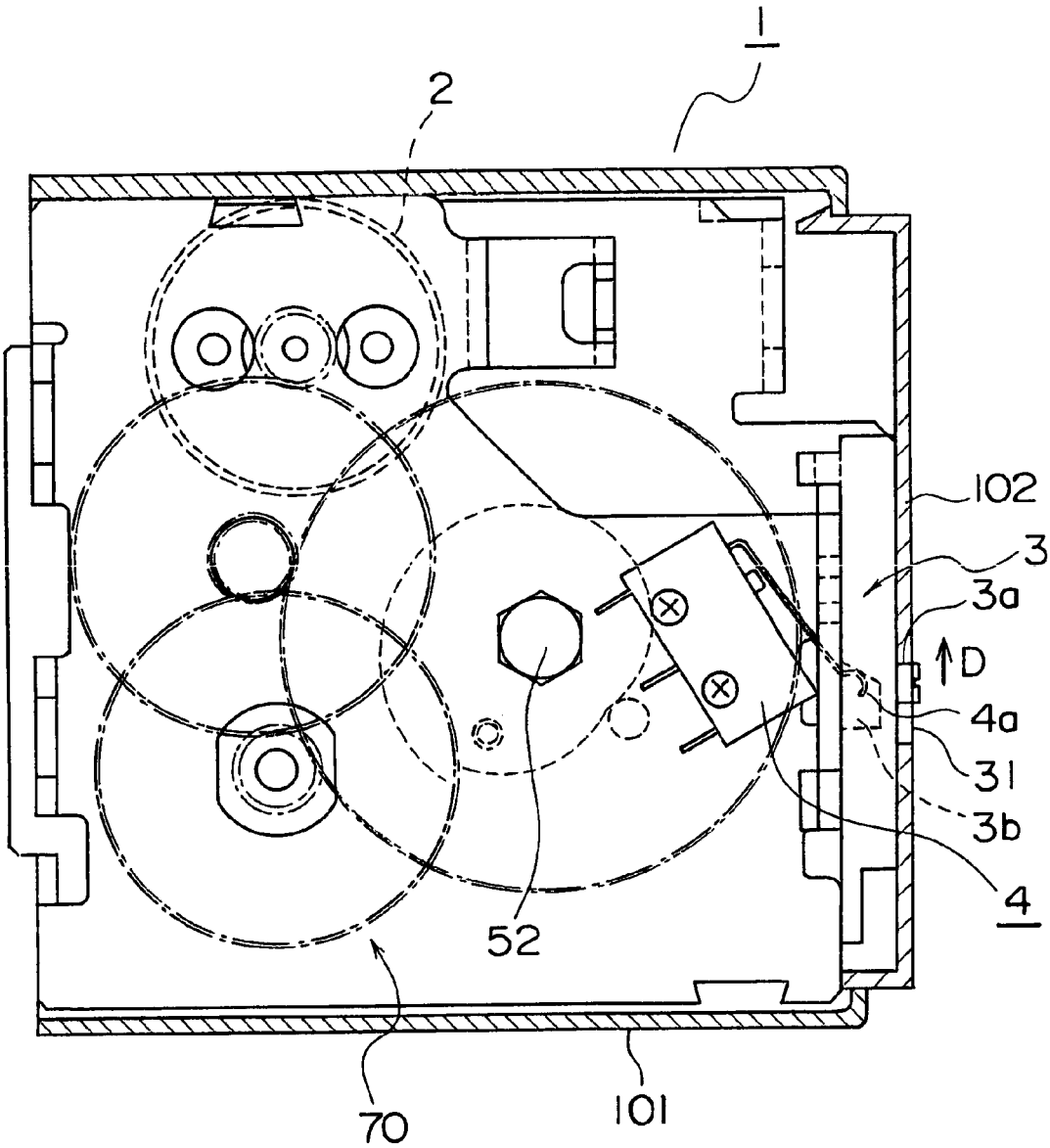
FIG. 3 is a left hand side view of the electrically operating apparatus shown in FIG. 2 with the housing removed.
Figure 4:
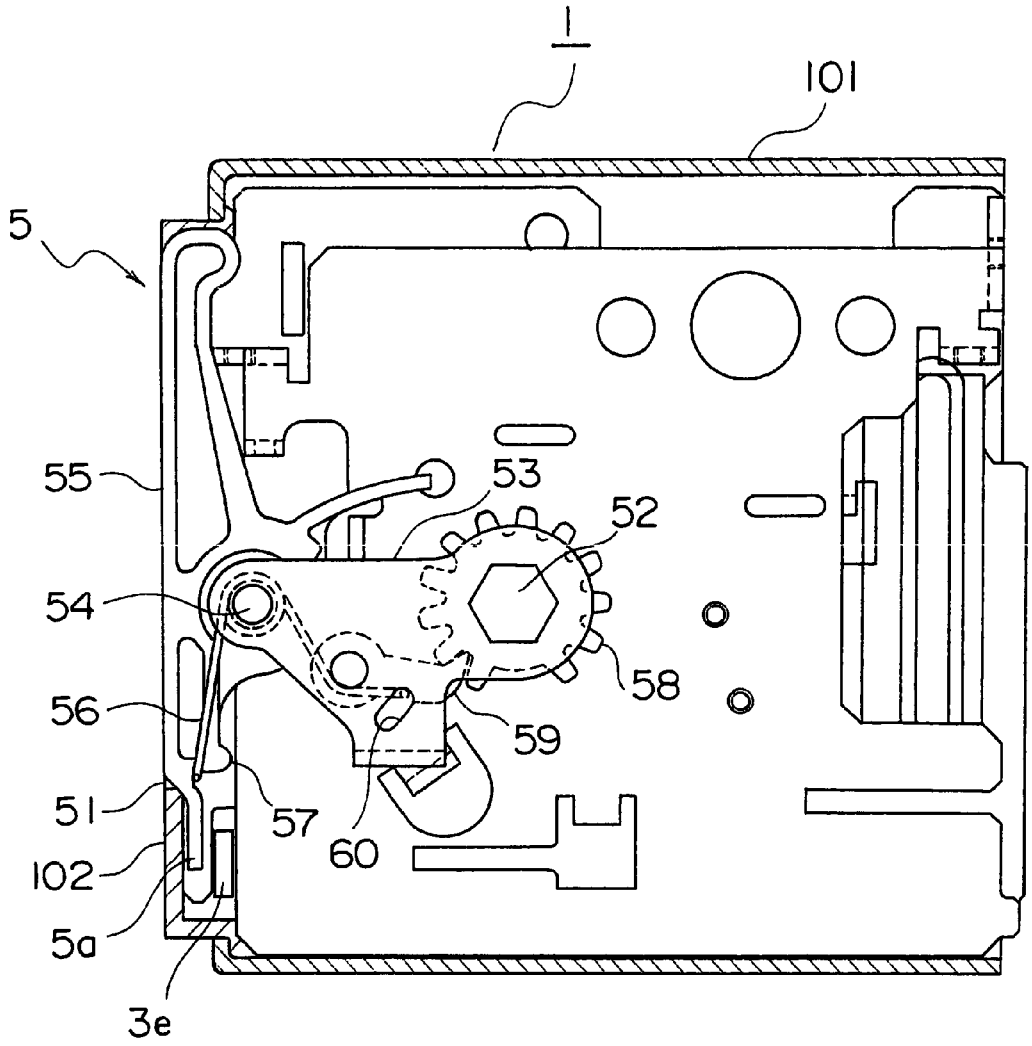
FIG. 4 is a right hand side view of the electrically operating apparatus shown in FIG. 2 with the housing removed.

The manual operation handle 5 will now be described. As shown in FIGS. 4 and 7, the manual operation handle 5, comprises a first link 53 connected to an energy charging means actuation shaft 52 causing energy charging means such as an illustrated charging spring, a second link 55 pivotally connected through a pin 54 to the first link 53, a spring 56 connected between the first and the second links 53 and 55 for biasing the second link 55 for rotation in the clockwise direction, a projection portion 57 formed in the second link 55 for engagement with the first link 53, a ratchet wheel 58 co-axially disposed with the energy charging means actuation shaft 52 and a pawl 59 pivotally attached to the first link 53 and engaging with the teeth of the ratchet wheel 58. While the pawl 59 is engaged by an end portion of the above-mentioned spring 56 and is biased for rotation in the counterclockwise direction, the pawl 59 is allowed to escape from the ratchet wheel 58 by being forcedly rotated in the clockwise direction against the spring 56. An elongated hole 60 is provided for allowing the pawl 59 to be forcedly rotated in the clockwise direction.

Figure 5:
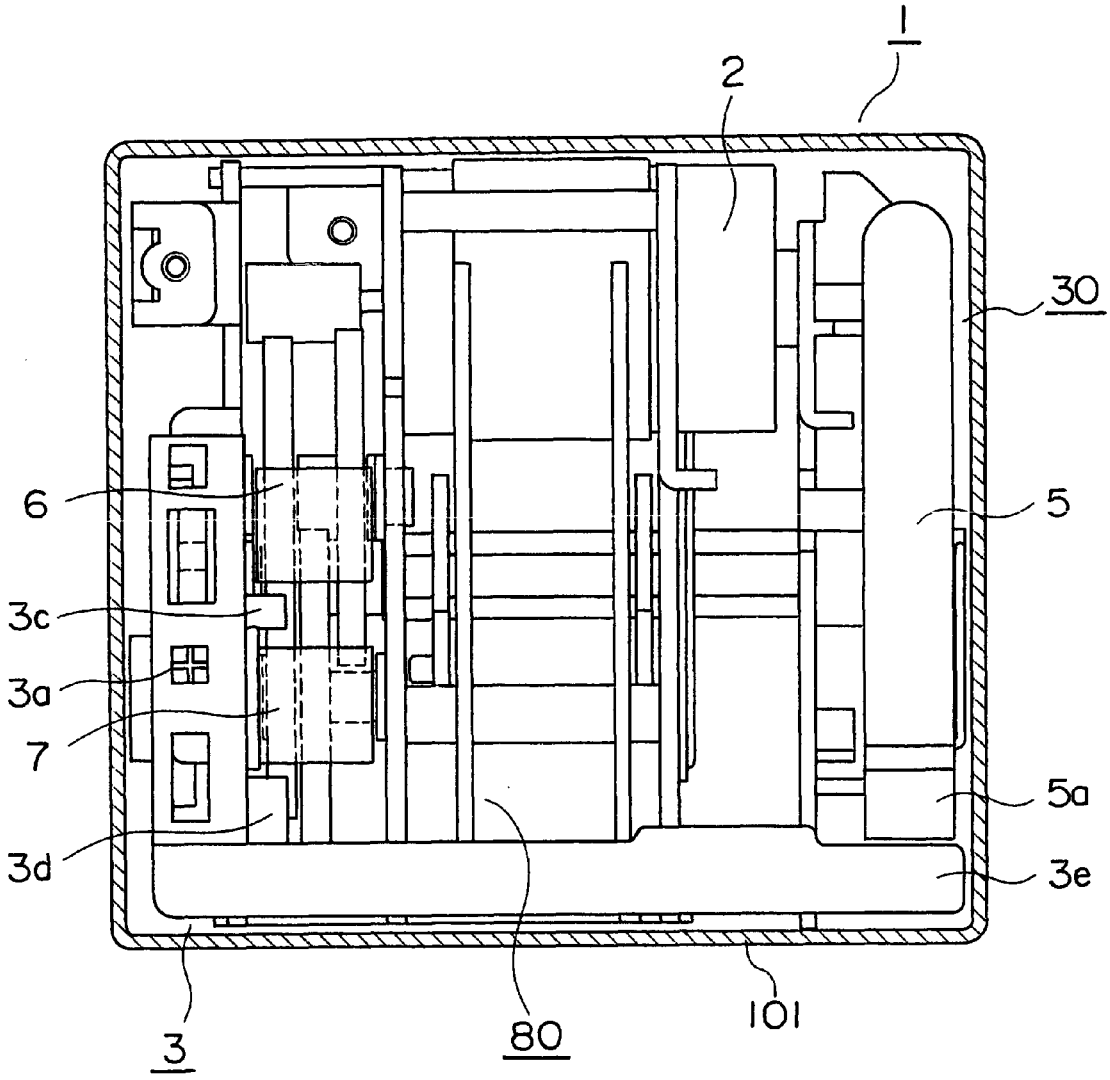
FIG. 5 is a front view of the electrically operating apparatus in the electrical operation mode with the housing removed.

When the manual operation handle 5 is moved from the retracted position shown in FIGS. 4 and 5 in which its operation is prevented into the position shown in FIG. 7 in which it is released and operable, the second lever 55 can be rotated clockwise through a first rotation range F1 about the pin 54 against the action of the spring 56 until the projection portion 57 abuts against the first lever 53. Then, the second lever 55 together with the first lever 53 is further rotated about the charging means actuation shaft 52 until it abuts against the stopper through a second rotation range F2. Then, by repeated rotational driving of the levers within the second rotational range F2 through the use of the engaging action between the ratchet wheel 58 and the pawl 59, the energy of the driving force can charged in the energy charging means.

The operation of the above-described first embodiment will now be described. The electrical operation mode, in which the changing-over of the circuit breaker 100 from the closed position to the open position or from the open position to the closed position is achieved by an electric motor, will first be described in conjunction with FIGS. 2 to 4.

When the operating knob 3*a* of the change-over lever 3 is slid as shown in the arrow D (FIG. 3), the changer-over lever 3 is moved into the electrical operation mode position, and the lever 4*b* of the switch 4 falls into the recessed portion 3*b* of the change-over lever 3, so that the switch 4 is shifted to supply an electric current to the drive motor 2.

At the same time, the first engagement portion 3*c* and the second engagement portion 3*d* integrally formed in the change-over lever 3 advance toward and overlap with the ON button 6 and the TRIP button 7, respectively. Also, the block portion 3*e* moves toward and overlaps with the tip portion 5*a* of the manual operation handle 5 (the hatched portion of FIG. 2). Thus, the ON button 6, the TRIP button 7 and the manual operation handle 5 are brought into engagement with the first engagement portion 3*c*, the second engagement portion 3*d* and the blocking portion 3*e*, respectively, whereby they are caught and brought into the state in which they are prevented from being operated. In this state, when the drive motor 2 is driven by remote operation, the drive force generated is transmitted to the mechanism portion 80 through the transmission gear 70. Then, the actuating pins 13 and 14 of the mechanism portion 80 moves the operation handle 12 in the up and down directions (FIG. 2), thereby causing the circuit breaker 100 to open or close.

Then, the description will be made in conjunction with FIGS. 5 to 7 in terms of the manual operation mode, in which the circuit breaker 100 is manually changed-over from the closed position to the open position or from the open position to the closed position. When the operating knob 3*a* of the change-over lever 3 is slid in the direction of the arrow E (FIG. 6), the change-over lever 3 moves into the manual operation mode position. At this time, the lever 4*a* of the switch 4 disengages from the recessed portion 3*b* of the change-over lever 3, so that the change-over lever 4 is switched not to supply an electric current to the drive motor 2.

At the same time, the first engagement portion 3*c* and the second engagement portion 3*d* of the change-over lever 3 retreat from the ON button 6 and the TRIP button 7 to come our of engagement therefrom. On the other hand, the blocking portion 3*e* of the change-over lever 3 retreats from the tip portion 5*a* of the manual operation handle 5 to disengage therefrom. Thus, the state is established in which the ON button 6, the TRIP button 7 and the manual operation handle 5 can be operated or driven. Therefore, when the ON button 6 is depressed, the circuit interrupter is closed by the action of the unillustrated charging spring, and when the TRIP button 7 is depressed the unillustrated trip device is tripped to open the circuit breaker.

Also, when the manual operation handle 5 is reciprocatingly moved within the second rotational range F2 with the first lever 53 and the second lever 55 brought into the position in which they are operated together (FIG. 7), the energy charging means actuating shaft 52 can be driven to charge the unillustrated charign spring and moving the operating knob 12 of the circuit breaker 100 by the actuating pin 13 to open the circuit breaker. In this manual operation mode, even when the drive motor 2 is attempted to be operated by the remote control operation whiel the ON button 6, the TRIP button 7 or the manual operation handle 5 are being operated, the electrical operation can be ensured to be prevented because no electrical current is supplied to the drive motor 2 due to the switching function of the switch 4.

Thus, according to this embodiment, during the electrical operation mode, the operations of not only the ON button 6, the TRIP button 7 but also the manual operation handle 5 can be prevented, the damages to the electrical operating unit 1 can be prevented, resulting in an advantage that a highly reliable electrical operating unit for a circuit breaker can be provided. Also, since the change-over lever 3 has integrally and unitary formed therein the first engagement portion 3*c*, the second engagement portion 3*d* and the blocking portion 3*e*, the structure of the electrically operating apparatus can be advantageously simplified.

Also, when the drive motor 2 in the manual operation mode was about to erroneously operated by remote operation by the switch 4 responsive to the change-over lever 3, the drive motor will not be driven because no electric current is supplied, avoiding an erroneous operation. Also, since the manual operation handle 5 is composed of the first lever 53 and the second lever 55 foldably pin-connected, so that the space in which the manual operation handle can be accommodated within the housing 101 can be made small, the overall dimensions of the electrically operating apparatus 1 can be made smaller.

While the present invention has been described in terms of a concrete structure of one embodiment of the present invention, many modifications and design changes can be made without departing from the scope of the present invention. For example, while the change-over lever 3 is slidable up and down direction in FIG. 2 to operating the electrically operating apparatus 1, it is also possible to arrange the change-over lever 3 so that it can be slid in the horizontal directions. Also, the L-shaped change-over lever 3 may be modified to have another configuration.

As has been described, according to the present invention, the apparatus for electrically operating a circuit breaker is arranged such that the change-over lever moves between an electrical operation mode position corresponding to the electrical operation mode and a manual operation mode position corresponding to the manual operation mode, and that the change-over lever has provided therewith a blocking portion which, while allowing the operation of the manual operation handle when the change-over lever is in the manual operation mode position, engages the manual operation handle to prevent the operation of the manual operation handle when the change-over lever is at the electrical operation mode position. Therefore, the operation of the manual operation handle in the electrical operation mode can be ensured to be prevented, avoiding the damages to the electrical operating apparatus, thsu enabling to provide a highly reliable apparatus for electrically operating a circuit breaker.

Also, the control panel may comprise an ON button for closing the circuit breaker in the manual operation mode and a TRIP button for opening the circuit breaker in the manual operation mode, and the change-over lever may be provided with a first engagement portion and a second engagement portion engaging the ON button and the TRIP button to prevent the operations of the ON button and the TRIP button when the change-over lever is shifted into the electrical operation mode. Therefore, erroneous operation can be prevented by preventing the button operation, allowing the remote operation in the electrical operation mode to be smoothly achieved.

Also, the change-over lever may have the blocking portion, the first engagement portion and the second engagement portion provided thereon as an integral and unitary structure, so that the levers have simpler structures and the structure of the electrically operating apparatus can be made simpler.

Alternatively, apparatus for electrically operating a circuit breaker may further comprise a switch disposed in the vicinity of the change-over lever for controlling electric current supply to the drive motor in response to the position of the change-over lever, the switch supplying the current to the drive motor when the change-over lever is in the electrical operation mode position and supplying no current to the drive motor when the change-over lever is in the manual operation mode, so that when the drive motor was to be erroneously driven by remote operation while the apparatus is being operated in the manual operation mode, the motor will not be driven because the switch is off, resulting in an advantageous result that the manual operation mode can be smoothly achieved.

Further, the manual operation handle may comprise a first link mounted to an energy charging means actuating shaft for actuating energy charging means, a second link pivotally connected to the first link and a spring for biasing the second link toward the position in which the second link is housed within the housing of the electrically operating apparatus, and the arrangement may be such that, when the manual operation handle is operated, the first link is rotated over a first rotation range in which the first link is rotated against the action of the spring until it engages with the second link as well as a second rotation range in which the first link, together with the second link, drives the energy charging means actuating shaft. Therefore, the manual operation handle can be retracted into the electrically operating apparatus housing, with the first and the second links of the handle folded, so that the accommodation space can be made small and the electrically operating apparatus can advantageously be made compact.

What is claimed is:

1. An apparatus for electrically operating a circuit breaker, in which a control panel on a housing of the circuit breaker is provided therein a change-over lever for selectively changing between an electrical operation mode and a manual operation mode, and in which the circuit breaker is operated between the open and closed positions by a drive force from a drive motor during the electrical operation mode and the circuit breaker is operated between the open and closed positions by a drive force from a manual operation handle during the manual operation mode;

the arrangement being such that said change-over lever moves between an electrical operation mode position corresponding to said electrical operation mode and a manual operation mode position corresponding to said manual operation mode, and that said change-over lever has provided therewith a blocking portion which, while allowing the operation of said manual operation handle when said change-over lever is in said manual operation mode position, engages said manual operation handle to prevent the operation of said manual operation handle when said change-over lever is at said electrical operation mode position.

2. The apparatus for electrically operating a circuit breaker as claimed in claim 1, wherein said control panel comprises an ON button for closing said circuit breaker in the manual operation mode and a TRIP button for opening said circuit breaker in said manual operation mode, and wherein said change-over lever is provided with a first engagement portion and a second engagement portion engaging with said ON button and said TRIP button to prevent the operations of said ON button and said TRIP button when said change-over lever is shifted into said electrical operation mode.

3. The apparatus for electrically operating a circuit breaker as claimed in claim 2, wherein said change-over lever has said blocking portion, said first engagement portion and said second engagement portion provided thereon as an integral and unitary structure.

4. The apparatus for electrically operating a circuit breaker as claimed in claim 1, further comprising a switch disposed in the vicinity of said change-over lever for controlling electric current supply to said drive motor in response to the position of said change-over lever, said switch supplying the current to said drive motor when said change-over lever is in said electrical operation mode position and supplying no current to said drive motor when said change-over lever is in said manual operation mode.

5. The apparatus for electrically operating a circuit breaker as claimed in claim 1, wherein said manual operation handle comprises a first link mounted to an energy charging means actuating shaft for actuating energy charging means, a second link pivotally connected to said first link and a spring for biasing said second link toward a position in which said second link is housed within said housing of said electrically operating apparatus, the arrangement being such that, when said manual operation handle is operated, said first link is rotated over a first rotation range in which said first link is rotated against the action of said spring until the first link engages with said second link as well as a second rotation range in which said first link, together with said second link, drives said energy charging means actuating shaft.

* * * * *